US005492501A

United States Patent [19]

Brown

[11] Patent Number: 5,492,501

[45] Date of Patent: Feb. 20, 1996

[54] BRASSIERE

[76] Inventor: James G. Brown, 17D Darius Dr., Cortland, N.Y. 13045

[21] Appl. No.: 619,384

[22] Filed: Nov. 29, 1990

[51] Int. Cl.[6] ..... A41C 3/12; A41C 3/14

[52] U.S. Cl. ..... 450/31; 450/55; 450/57; 2/73

[58] Field of Search ..... 2/73, 67; 450/32, 450/37, 55, 60, 70, 30, 31, 38, 39, 40, 53, 54, 56, 57, 71, 74, 75, 76, 77

[56] References Cited

U.S. PATENT DOCUMENTS

| | | | |
|---|---|---|---|
| 2,632,169 | 3/1953 | Silvani | 450/55 |
| 2,664,568 | 1/1954 | Wegman | 450/1 |
| 2,888,930 | 6/1959 | Coleman et al. | 450/70 X |
| 3,221,747 | 12/1965 | Blair | 450/55 |
| 3,266,495 | 8/1966 | Sachs | 450/55 |
| 3,399,678 | 9/1968 | Faron | 450/55 |
| 3,665,929 | 5/1972 | Brantly | 450/70 |
| 4,091,819 | 5/1978 | Huber et al. | 450/55 |

FOREIGN PATENT DOCUMENTS

| | | | |
|---|---|---|---|
| 693525 | 7/1940 | Germany | 450/37 |
| 0480813 | 12/1969 | Switzerland | 450/70 |

*Primary Examiner*—Jeanette E. Chapman
*Attorney, Agent, or Firm*—Philip Furgang

[57] ABSTRACT

A pair of breast receiving cups are carried in spaced relationship by a body encircling portion of a brassiere. Clamp means are provided to position and maintain the brassiere in position on a person with their breasts disposed in the breast receiving cups. A pair of shoulder straps are carried by the brassiere to facilitate its disposition when worn. Each breast receiving cups includes a centrally disposed support portion that is sized and configured to be wider at a position thereof beneath the wearer's breast and which extends therefrom tapering inwardly, passing over the wearer's nipple to a relatively narrow end connected to the bra strap above what would otherwise be an upper periphery of the breast cup. Each support portion includes a substantially 1/16 inch thick foam piece covered by a piece of material with an aesthetic surface treatment such as lace all secured together by being peripherally sewn into the breast cup construction.

13 Claims, 1 Drawing Sheet

BRASSIERE

BACKGROUND OF THE INVENTION-FIELD OF APPLICATION

This invention relates to brassieres; and, more particularly, to the breast supporting portions of brassieres.

BACKGROUND OF THE INVENTION-DESCRIPTION OF THE PRIOR ART

Brassieres, or bras as they are quite often referred to, are available in many different configurations and constructions. Essentially brassieres are intended to provide a covering for and probably a support for a woman's breasts. Each particular construction and each particular configuration is designed to achieve an intended effect, appearance and in many instances type of breast support. Brassiere constructions may also be somewhat complex in that they must withstand numerous washings and re-wearings while still attempting to repeat the intended support and effect. Needless to say this is difficult to achieve and not all brassieres succeed.

In general most brassieres include a body encircling portion and breast cups. Some brassieres are provided with shoulder straps and others are strapless. The construction of the breast cup portions of many brassieres does not seem, however, to provide a desired lifting and shaping of the woman's breasts.

Brassieres such as those shown in U.S. Pat. No. 2,061,739 granted on Nov. 24, 1936 to H. Rasch for Brassiere provide overlapping breast covering pieces unattached along some edges to accommodate different breast sizes but as a result of this construction may not provide an adequate and uplifting breast support. On the other hand, brassieres such as shown in U.S. Pat. No. 2,517,287 granted on Aug. 1, 1950 to G. Corbeil, Nee Laporte for Brassiere rely merely upon darts and a stiff reinforcement which only extends up to approximately the breast nipple and this may very well prove to provide inadequate support and uplift while the stiff reinforcement may render the brassiere too uncomfortable to wear.

Brassieres such as those shown and described in U.S. Pat. No. 2,443,127 granted on Jun. 8, 1948 to J. G. Abeles for Strapless Brassieres, in U.S. Pat. No. 2,524,620 granted on Oct. 3, 1950 to E. Cadous for Brassiere, and in U.S. Pat. No. 2,592,265 granted on Apr. 8, 1952 to E. M. Fyffe for Brassiere all require the use of stiffeners in the form of stays or bones to achieve their intended purposes. While such stays and bones are allegedly "flexible" they nevertheless quite often end up poking the wearer and creating sensitive and uncomfortable sore spots. As the garment wears due to use and washings the stays and bones tend to rip through the garment and move around thus often rendering the garment unwearable.

Another brassiere construction is shown and described in U.S. Pat. No. 2,378,908 granted on Jun. 26, 1945 to N. Blum for Brassiere, however, attempts to support the women's breasts by support portions which extend up a relatively short extent terminating short of the breast nipple. Such a construction would not appear to provide sufficient support and uplift for many women and may thus be unacceptable to them.

U.S. Pat. No. 2,305,051 granted on Dec. 15, 1942 to M. Witkower for Brassiere provides a band or tape of uniform width extending from the base of the breast cup to the top of the breast cup but only for the purpose of securing breast pockets in place when not otherwise opened to facilitate nursing of an infant. The bands or tapes of Witkower do not and cannot provide an effective support and uplift for the wearer's breasts and would be unacceptable for that purpose.

Brassieres such as shown and described in U.S. Pat. No. 2,984,242 granted on May 16, 1961 to T. B. Schaumer for Brassiere require a body encircling band to achieve a desired breast uplifting. Schaumer utilizes a section of reinforcing material extending from the base of the breast cup over the apex thereof, but the Schaumer construction also requires the use of inelastic reinforcing straps and the reinforcing section is of substantially equal width for its entire extent. Such a construction may prove to be uncomfortable to wear due to its requirement for inelastic reinforcing straps and may be otherwise unacceptable because it may not provide the desired support and uplift.

SUMMARY OF THE INVENTION

It is therefore an object of this invention to provide a new and novel brassiere.

It is another object of this invention to provide a new and novel breast cup construction for a brassiere.

It is another object of this invention to provide a new and novel breast support construction for the breast cups of a brassiere.

It is yet another object of this invention to provide a new and novel breast cup construction for a brassiere that provides a desired uplift for the woman's breasts.

It is still another object of this invention to provide a new and novel brassiere construction which provides a desired support and uplift for the wearer's breasts.

Other objects, features, and advantages of this invention in its details of construction and arrangement of parts will be seen from the above, from the description of the preferred embodiment when considered with the drawing and from the appended claims.

DESCRIPTION OF THE PREFERRED EMBODIMENT

Figure 1:
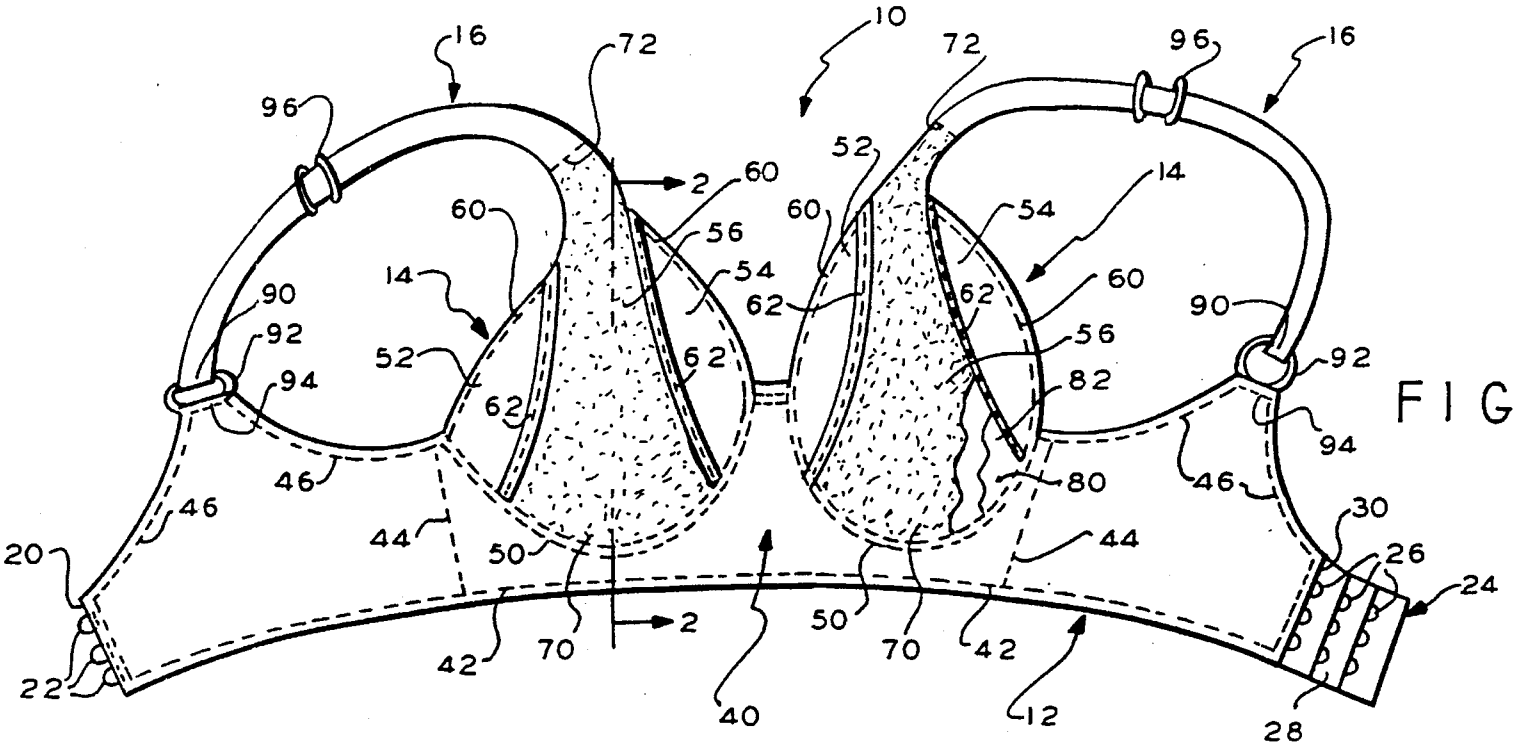
FIG. 1 is a front view of a brassiere incorporating the instant invention cut away in part to better show details thereof.

With reference to FIG. 1 there is generally shown at 10 a brassiere including a body encircling portion 12, a pair of breast cups 14 and a pair of shoulder straps 16. Body encircling portion 12 terminates at an end 20 along which are secured, as by sewing or the like, a number of hooks 22 of conventional construction and at its other end 24 at which are secured, as by sewing or the like, a number of rows each containing a number of eyelets 26. If desired eyelets 26 may be attached to an elasticized piece of material 28 secured, as by sewing, at a location 30. Hooks 22 and eyelets 26 coact together to form a clasp for securing body encircling portion 12 and brassiere 10 in place on a person.

Body encircling portion 12 is otherwise fabricated from one or more sections of suitable and appropriate material 40 cut or otherwise formed to the desired peripheral configuration and secure together as by sewing or the like the material may be folded along its peripheral edges or otherwise reinforced by stitching such as shown at 42, 44 and 46 all in substantially conventional manner. If desired, a surface material such as lace or other aesthetic treatment may be applied to body encircling portion 12. The sizing of the length and height of body encircling portion 12 is selected, in conventional manner, to provide brassieres in the desired range of sizes.

Breast cups 14 and their respective locations and sizes are similarly selected to accommodate and provide brassieres in the desired range of sizes. Each breast cup 14 is secured in place to body encircling portion 12 along lines 50 by sewing or the like; and each includes a pair of beast side panels 52, 54 and a support center panel 56. Side panels 52, 54 are each of any selected material which may or may not have an aesthetic treatment, such as lace applied to its surface. Said side panels 52, 54 are secured to body encircling portion 12, as by sewing or the like along lines 60 and to center panels 56, as by sewing or the like, along lines 62. If desired, the materials from which all or a portion of center panels 56 are fabricated may be folded over along lines 62 prior to being secured in place as by sewing or the like.

Each support or center panel 56 of each breast cup 14 is fabricated to be relatively wide at its bottom 70 where they are respectively secured to body encircling portion 12. From bottoms 70 center panels 56 taper inwardly until an upper edge 72 where center panels 56 are respectively secured to bra straps 16. In extending from their bottoms 70 to their upper edges 72 center panels 56 are sized and configured so that when bra 10 is worn center panels 56 will pass over the breast nipples of the wearer and extend up passed the upper extremity of breast cups 14.

Figure 2:
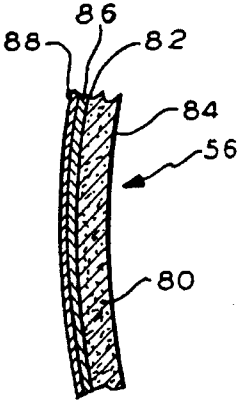
FIG. 2 is a partial sectional view taken on line 2—2 of FIG. 1.

Each support center panel 56 includes a base layer 80 (FIGS. 1 and 2) of foam of predetermined thickness. In this instance the thickness of foam layer 80 is selected to be 1/16 (one sixteenth) of an inch. If desired, a fabric layer 82 may be bonded to one surface of foam layer 80 and a fabric layer 84 (FIG. 2) bonded to the other surface thereof. A layer of material 86 such as cotton, polyester, rayon or other suitable and conventionally available material is provided on top of foam layer 80 and if desired an aesthetic surface treatment such as a layer of lace material 88 is disposed over material layer 86. These layers of material 86, 88 and foam layer 80 are cut and shaped to the same size and peripheral configuration and are secured together about their respective peripheries as by sewing or the like along lines 62.

The size and configuration of center panels 56 (i.e. relatively wide at their bottoms where they join body encircling portion 12, extending therefrom over where the breast nipple would be and tapering to a relative narrow upper edge extending passed the upper periphery of breast cup 14) and its fabrication including a layer of foam provides a breast cup which supports and provides a desired uplift for the wearer's breasts.

Bra straps 16 are of conventional construction and are formed of conventional bra strap materials. Each strap 16 is secured to the respective upper edge 72 of its respective center panel 56 and extends therefrom to terminate at ends 90 connected by rings 92 at strap connection portions 94 formed on body encircling portion 12. Buckles 96 of conventional construction are provided for each strap 16 to facilitate adjustment of the length thereof in a conventional manner.

From the above description it will thus be seen that there has been provided a new and novel brassiere which through the use of a relatively thin foam and fabric construction built into the breast cups provides an efficient and effective support and uplift for the wearer's breasts.

It is understood that although there has been shown the preferred embodiment of the invention that various modifications may be made in the details thereof without departing from the spirit as comprehended by the following claims.

What is claimed is:

1. A brassiere, comprising:

(a) body encircling means;

(b) clasp means, for maintaining said body encircling means, disposed about the body of a person in proximity to their breast; and (c) breast cup means, carried by said body encircling means, to receive the breasts of a person when said body encircling means is disposed about the person;

(d) said breast cup means including a pair of spaced breast cups each of which includes a cup body of a size and configuration to receive and encompass a person's breast; each said cup body extending from a first portion, which when said breast cup means is worn would be disposed beneath a person's breast, to a second portion disposed on top of a person's breast;

(e) each of said cup body means including a pair of breast panels and a support portion extending from said first portion to said second portion and which coacts with the person's breast when worn to support and uplift the breast; said support portion is relatively wide at said first, portion and tapes inwardly until said second portion; said second portion extends further than an upper periphery of said breast cup;

(f) one of each of said pair of breast panels being disposed along a respective side of said support portion and connected thereto.

2. The brassiere of claim 1, wherein said second portion extends further than an upper periphery of said breast cup.

3. The brassiere of claim 1, including a bra strap having a first end connected to said second portion of each of said breast cups and a second end connected in spaced relationship therewith to said body encircling means.

4. The brassiere of claim 1, wherein each said support portion includes a relatively thin and firm foam piece.

5. The brassiere of claim 4, wherein said foam piece is of a predetermined thickness.

6. The brassiere of claim 5, wherein said foam piece is substantially one-sixteenth of an inch thick.

7. The brassiere of claim 6, wherein said foam piece is coextensive with the size and configuration of said support portion.

8. The brassiere of claim 7, wherein said support portion, including said foam piece is relatively wide at said first portion and tapers inwardly until said second portion.

9. The brassiere of claim 8 wherein said foam piece is covered by a fabric along at least one of its surfaces.

10. The brassiere of claim 9, wherein said foam piece is bonded between a pair of fabric coverings.

11. The brassiere of claim 10, wherein said support portion also includes a fabric portion secured to said foam piece about the respective peripheries thereof.

12. The brassiere of claim 11, wherein said support portion also includes an aesthetic covering disposed on said fabric portion on a surface thereof opposite to said foam piece.

13. The brassiere of claim 12, wherein said covering is lace-like.

* * * * *